US009839836B2

(12) United States Patent
Connolly et al.

(10) Patent No.: US 9,839,836 B2
(45) Date of Patent: Dec. 12, 2017

(54) LOTTERY TICKET AND METHOD FOR DETERMINING A PRIZE ASSOCIATED WITH THE LOTTERY TICKET

(75) Inventors: David P. Connolly, Mt. Pearl (CA); Blair M. Connolly, Paradise (CA)

(73) Assignee: BRITISH BAZAAR COMPANY LIMITED, St. John's, Newfoundland (CA)

( * ) Notice: Subject to any disclaimer, the term of this patent is extended or adjusted under 35 U.S.C. 154(b) by 762 days.

(21) Appl. No.: 12/715,962

(22) Filed: Mar. 2, 2010

(65) Prior Publication Data

US 2011/0190042 A1 Aug. 4, 2011

(30) Foreign Application Priority Data

Jan. 29, 2010 (CA) ..... 2691896

(51) Int. Cl.
*G06F 17/00* (2006.01)
*A63F 3/06* (2006.01)

(52) U.S. Cl.
CPC ..... *A63F 3/06* (2013.01)

(58) Field of Classification Search
USPC ..... 22/12; 283/56; 235/375, 487; 273/138.1, 269; 463/16, 17
See application file for complete search history.

(56) References Cited

U.S. PATENT DOCUMENTS

| | | | | |
|---|---|---|---|---|
| 5,915,588 | A * | 6/1999 | Stoken et al. | 221/2 |
| 5,949,042 | A * | 9/1999 | Dietz et al. | 235/375 |
| 6,948,742 | B2 * | 9/2005 | Buck | 283/56 |
| 7,344,086 | B2 * | 3/2008 | Grossman et al. | 235/487 |
| 2006/0012116 | A1 * | 1/2006 | Lovell, Sr. | 273/138.1 |
| 2006/0197283 | A1 * | 9/2006 | Thinnes | 273/269 |
| 2006/0211470 | A1 * | 9/2006 | Walker et al. | 463/16 |

* cited by examiner

*Primary Examiner* — Masud Ahmed
(74) *Attorney, Agent, or Firm* — Thompson Hine LLP

(57) ABSTRACT

A method for determining a prize associated with a lottery ticket. An identifier is disposed on the lottery ticket and at least partially concealed in a substantially tamper-proof fashion. The identifier is uniquely related to the lottery ticket such that each lottery ticket of a plurality of lottery tickets has a unique identifier and is uniquely related to prize data stored in a trusted database. The prize data is indicative of the prize associated with the lottery ticket. After revealing data indicative of the identifier are provided to a trusted processor in communication with the trusted database. Using the trusted processor data indicative of the prize associated with the lottery ticket is determined in dependence upon the data indicative of the identifier and the prize data is provided for displaying in a human comprehensible fashion. Further, a lottery ticket is provided. The lottery ticket comprises a break open tab wherein an identifier is disposed in proximity to a hinged part of the tab.

14 Claims, 14 Drawing Sheets

| PRIZE $ | IDENTIFIER |
|---|---|
| 000050.00 | 3471059219 |
| 000000.00 | 7451954219 |
| 000000.00 | 0279457205 |
| 001000.00 | 3907150620 |
| 000050.00 | 1495208031 |
| 000000.00 | 9130820744 |
| 000000.00 | 1590037180 |
| 000000.00 | 7856106844 |
| 000000.00 | 3501920117 |
| 000050.00 | 5890357079 |
| 000200.00 | 3814852770 |
| 000000.00 | 9091730100 |
| 000000.00 | 5031720809 |
| 000050.00 | 2471014680 |

Figure. 1d

LOTTERY TICKET AND METHOD FOR DETERMINING A PRIZE ASSOCIATED WITH THE LOTTERY TICKET

This application claims priority to Canadian patent application No. 2,691,896, entitled LOTTERY TICKET AMD METHOD FOR DETERMINING A PRIZE ASSOCIATED WITH THE LOTTERY TICKET, filed on Jan. 29, 2010, the entire contents of which are hereby incorporated by reference.

FIELD OF THE INVENTION

The present invention relates to lottery tickets, and more particularly to an instant lottery tickets including pull-tab and break-open type lottery tickets and a method for determining a prize associated with such lottery tickets.

BACKGROUND OF THE INVENTION

Instant lottery games have become an important source of income to governments and numerous non-for-profit organizations. Typically, a set of instant lottery tickets is imaged with play and prize value indicia under a scratch-off coating according to a predetermined prize structure. The prize structure often comprises a relatively small number of large value prize tickets, a number of lesser value prize tickets, and a large number of void tickets. The prizes are distributed randomly to the tickets such that each ticket purchased by a player has an equal chance to win one of the prizes.

The tickets are then distributed to ticket retailers—such as, for example, convenience stores, supermarkets, gas stations, gift shops, etc.—for dispensing the tickets to consumers and for validating the tickets when they are presented for redemption.

With numerous instant lottery games on the market it has become a challenge to sustain public interest. In response, larger valued prizes are offered in various instant lottery games. However, with the increased value of the prizes there is an increased risk that individuals having access to the tickets, for example, employees of the ticket retailer attempt to identify the winning tickets—i.e. attempt to access prize information on the tickets—in a set of tickets for sale, referred to as "fishing".

Instant lottery tickets typically comprise a substrate such as a sheet of, for example, thin cardboard or boxboard, having a secure area and a graphic area with the information printed in the secure area, for example, in the form of a barcode, being hidden by one or more opaque scratch-off layers printed there over. Unfortunately, the coatings used for the scratch-off layers may be incompatible with some lithographic printing processes that produce high quality images and, therefore, instant lottery tickets are visually less appealing. This presents a significant disadvantage since instant lottery tickets may be impulse purchase items and the overall aesthetic appeal substantially affects marketability.

Furthermore, removing the scratch-off layers using, for example, a finger nail or sharp object is a cumbersome process and bar code scanners are known to have reliability problems when a portion of the barcode has been damaged during removal of the scratch-off layers.

It is desirable to provide a method for determining a prize associated with a lottery ticket that substantially reduces the risk of fishing.

It is also desirable to provide an instant lottery ticket that reduces the risk of fishing and has aesthetic appeal.

SUMMARY

Accordingly, one object of the present invention is to provide a method for determining a prize associated with a lottery ticket that substantially reduces the risk of fishing.

Another object of the present invention is to provide an instant lottery ticket that reduces the risk of fishing and has aesthetic appeal.

According to one aspect of the present invention, there is provided a method for determining a prize associated with a lottery ticket. An identifier is disposed on the lottery ticket and at least partially concealed in a substantially tamper-proof fashion. The identifier is uniquely related to the lottery ticket such that each lottery ticket of a plurality of lottery tickets has a unique identifier and is uniquely related to prize data stored in a trusted database. The prize data is indicative of the prize associated with the lottery ticket. After revealing, data indicative of the identifier is provided to a trusted processor in communication with the trusted database. Using the trusted processor data indicative of the prize associated with the lottery ticket is determined in dependence upon the data indicative of the identifier and the prize data, which is then provided for displaying in a human comprehensible fashion.

According to one aspect of the present invention, there is provided a lottery ticket. The lottery ticket comprises a sheet type body having a predetermined size and shape. An identifier is disposed on the body. The identifier is uniquely related to the lottery ticket such that each lottery ticket of a plurality of lottery tickets has a unique identifier and is uniquely related to prize data stored in a trusted database. The prize data is indicative of the prize associated with the lottery ticket. A concealment conceals at least partially the identifier in a substantially tamper-proof fashion.

According to another aspect of the present invention, there is provided a lottery ticket. The lottery ticket comprises a top sheet having an upper surface and a lower surface and a bottom sheet having an upper surface and a lower surface. The upper surface of the bottom sheet is partially adhered to the lower surface of the top sheet. At least a tab is disposed in the bottom sheet. The tab has a hinged part and a severable part. The severable part of the tab is for being severed from the bottom sheet for revealing a predetermined portion of the lower surface of the top sheet with the hinged part of the tab being connected to the bottom sheet. An identifier is disposed on the predetermined portion of the lower surface of the top sheet in proximity to the hinged part of the tab. The identifier is for being compared with data stored in a trusted database.

One advantage of the present invention is that it provides a method for determining a prize associated with a lottery ticket that substantially reduces the risk of fishing.

A further advantage of the present invention is that it provides an instant lottery ticket that reduces the risk of fishing and has aesthetic appeal.

BRIEF DESCRIPTION OF THE DRAWINGS

An embodiment of the present invention is described below with reference to the accompanying drawings, in which:

FIGS. 1*c* and 1*d* are simplified block diagrams illustrating look-up tables for use with the method for determining a prize associated with an instant lottery ticket according to an embodiment of the invention;

DETAILED DESCRIPTION

Unless defined otherwise, all technical and scientific terms used herein have the same meaning as commonly understood by one of ordinary skill in the art to which the invention belongs. Although any methods and materials similar or equivalent to those described herein can be used in the practice or testing of the present invention, certain particular methods and materials are now described.

While the description of the various embodiments herein below is with reference to the use of a linear barcode, it will become evident to those skilled in the art that the embodiments of the invention are not limited thereto, but are also applicable for use with matrix 2-D barcode or other methods of optical recognition such as, for example, Optical Character Recognition (OCR).

Figure 1A:
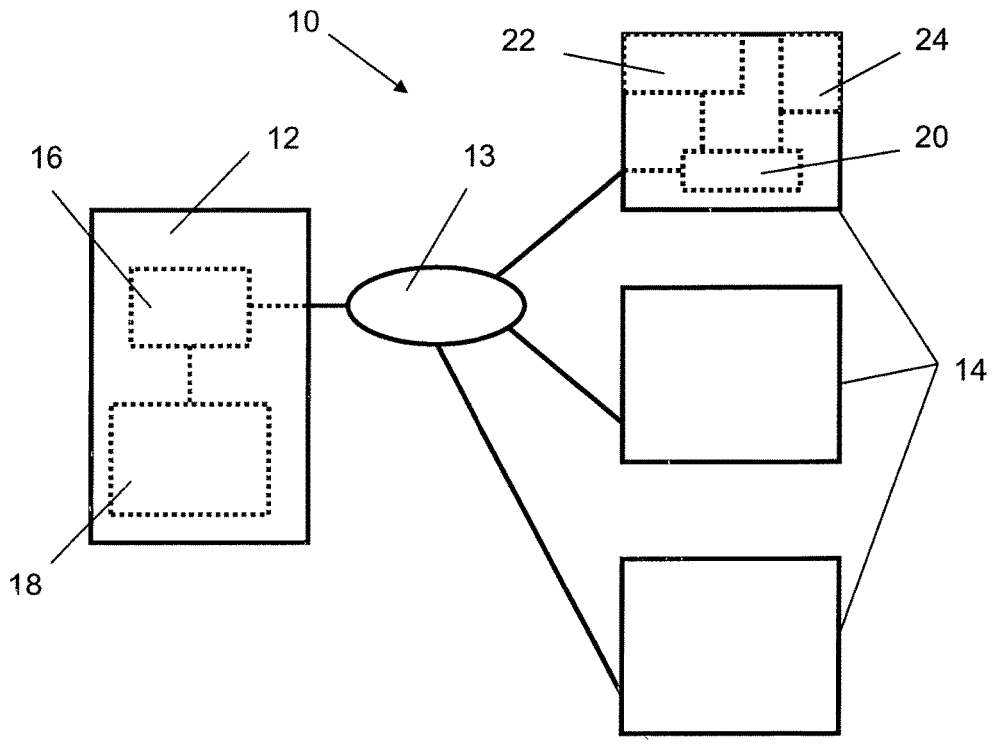
FIGS. 1*a* is a simplified block diagram illustrating a computer system for implementing a method for determining a prize associated with an instant lottery ticket according to an embodiment of the present invention.

Referring to FIGS. 1*a* to 1*f*, a method for determining a prize associated with an instant lottery ticket according to an embodiment of the invention is provided. The method is implemented, for example, using a present day lottery system 10, as illustrated in FIG. 1*a*. The system 10 comprises a central data processing unit 12 which is connected to terminals 14 via a communication network 13 such as, for example, the Internet. The central data processing unit 12 is placed in a trusted entity such as, for example, an administrative center or headquarters of the lottery operator and comprises a trusted processor 16 and a trusted database 18. The terminals 14 are located at ticket retailers for dispensing the tickets and for validating the tickets when presented for redemption and comprise, for example, a processor 20, a display 22, and a barcode reader 24. The processor 20 communicates with the trusted processor 16, the barcode reader 24, and the display 22 as will be described herein below.

Figure 1B:
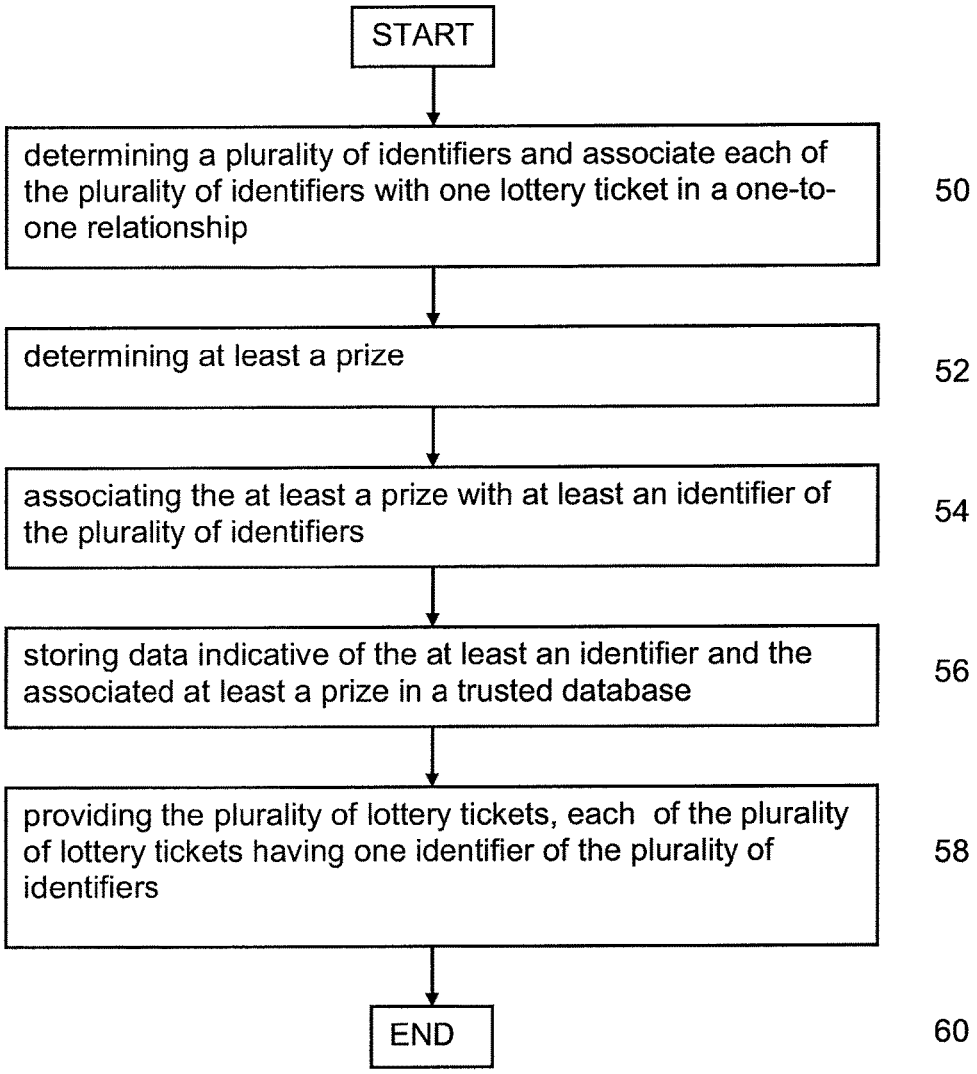
FIG. 1*b* is a simplified flow diagram illustrating a method for determining a prize associated with an instant lottery ticket according to an embodiment of the present invention.
Figure 1C:
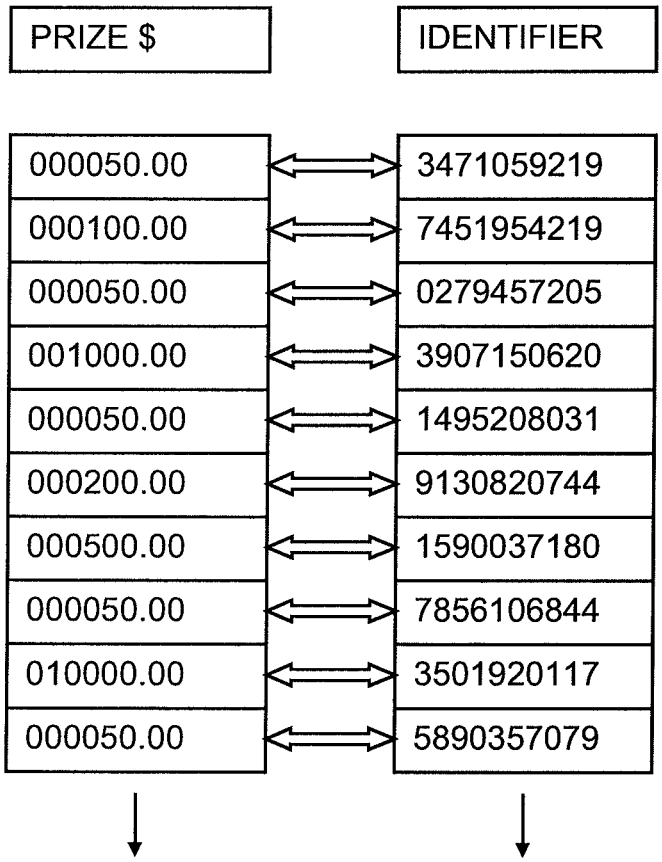

Referring to FIG. 1*b*, a plurality of identifiers are determined using, for example, the trusted processor 16 and each of the plurality of identifiers is associated with one lottery ticket in a one-to-one relationship—50. Each identifier is unique and comprises, for example, a sequence of numbers, a sequence of characters, a sequence of symbols, or a combination thereof and is determined, for example, in a random or pseudo-random fashion. At 52, at least a prize is determined and information indicative of the at least a prize is associated with at least an identifier of the plurality of identifiers—54. Data indicative of the at least an identifier and information indicative of the associated at least a prize are then stored—56—in the trusted database 18. The data are stored, for example, in the form of a look-up table, as illustrated in FIG. 1*c*. For example: the identifier is stored in a memory location having a first address and the information indicative of the associated prize is stored in a memory location having a successive address which is accessed immediately after the first address; the identifier and the prize information are stored in same or linked/related memory locations; or, for example, the identifier is the address of the memory location of the corresponding prize. Optionally, the prize—the dollar amount illustrated in FIG. 1*c*—is, for example, replaced by a single number such as 1 for a first prize, 2 for a second prize, etc., thus reducing the storage space used for storing the information in the trusted database. The actual prize—for example, the dollar amount is then determined by the trusted processor 16 in dependence upon the retrieved number. As illustrated in FIG. 1*c*, only the identifiers of tickets having a prize associated therewith are stored in the trusted database 18. Alternatively, all identifiers are stored in the trusted database 18, as illustrated in FIG. 1*d*. For example, the identifier of a void ticket has a zero prize value associated therewith. At 58, the plurality of lottery tickets is then produced and distributed to the retailers. Each ticket of the plurality of tickets has one identifier of the plurality of identifiers.

Figure 1E:
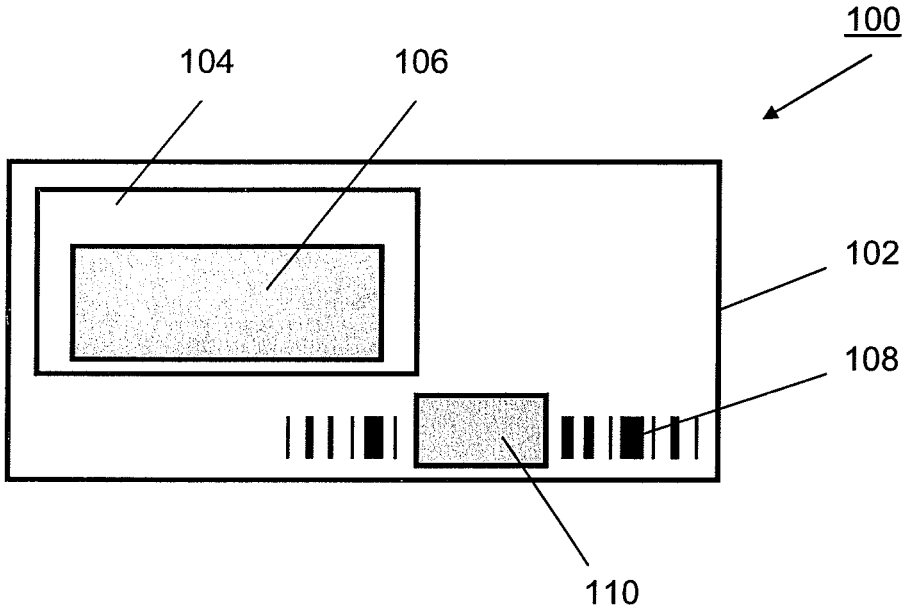
FIG. 1*e* is a simplified block diagram illustrating an instant lottery ticket according to an embodiment of the invention.

Referring to FIG. 1*e*, a lottery ticket 100 according to an embodiment of the invention is provided. The lottery ticket 100 comprises a sheet type body 102 such as, for example, a semi-rigid sheet of paper, cardboard, or boxboard having a predetermined shape—for example, rectangular shape—and size. The identifier is printed on the body 102 in the form of a barcode 108 such as, for example, a linear barcode, or a matrix barcode. As described herein above, the identifier is uniquely related to the lottery ticket such that each lottery ticket of a plurality of lottery tickets has a unique identifier and is uniquely related to prize data stored in the trusted database 18. Optionally, at least a portion of the identifier is encoded using, for example, an error correcting code such as a Reed Salomon code to provide an indication that the identifier has been corrupted and/or to retrieve the identifier in case the barcode has been damaged.

Concealment 110 either fully conceals at least partially conceals the identifier 108 in a substantially tamper-proof fashion. The concealment comprises, for example, a second sheet type body, which is partially adhered to the sheet type body 102 and comprises at least a break open tab. Alternatively, the concealment comprises one or more layers of opaque scratch-off layers disposed upon all or at least a portion of the identifier 108.

The lottery ticket 100 may further comprise a play area 104 which is partially concealed using concealment 106. Alternatively, the identifier 108 is integrated into the play area 104.

Optionally, a second identifier is disposed in an unconcealed fashion on the lottery ticket and is, for example, indicative of a validation number or inventory number. For example, a retailer "activates" the lottery ticket by reading the second identifier and providing it to the central data processing unit 12 prior the display of the lottery ticket for sale, enabling the lottery organization to track the sale of the lottery tickets at the various retailers.

It is noted that each lottery ticket also typically comprises a Universal Product Code (UPC) which is, for example, printed on the backside of lottery ticket.

Figure 1F:
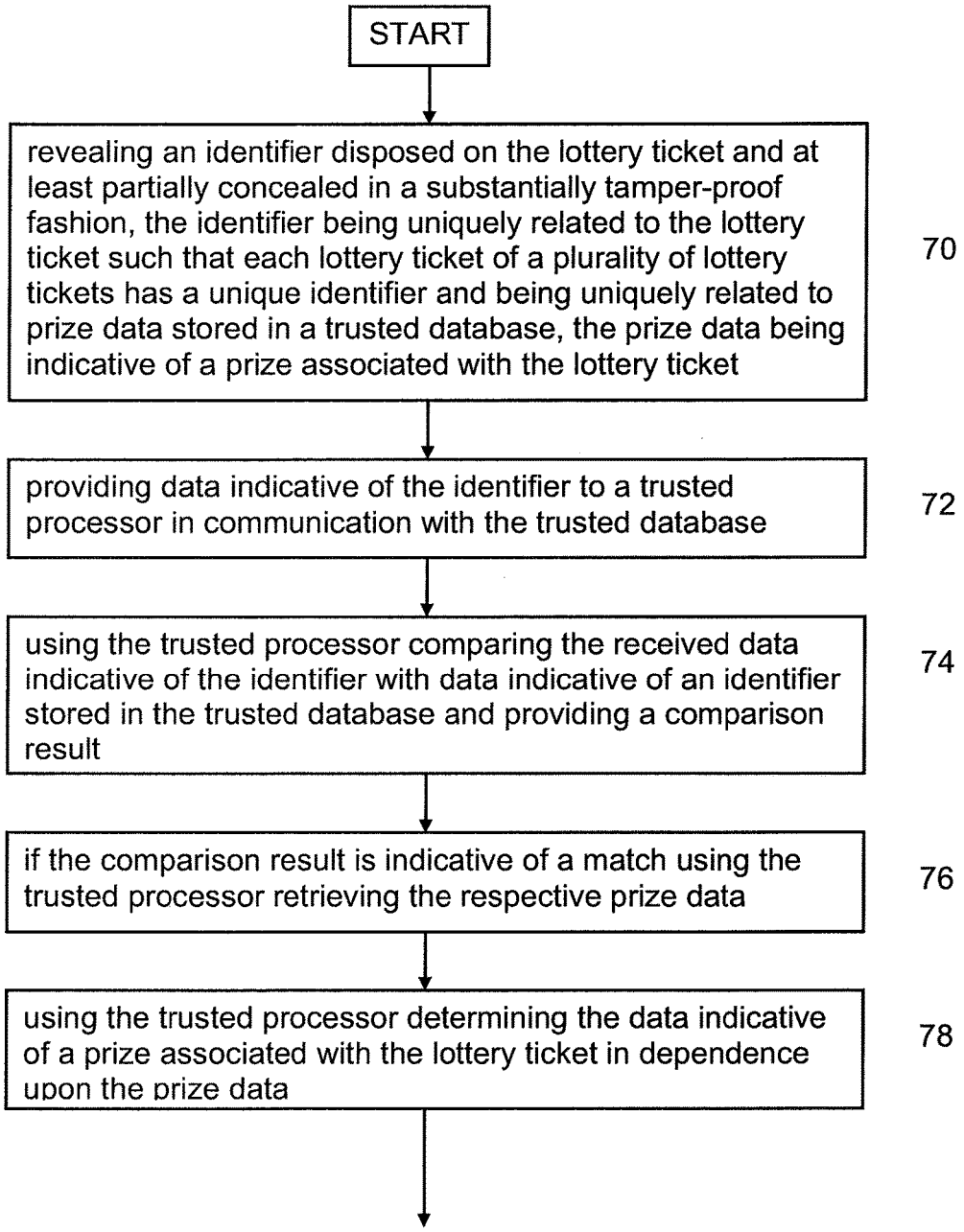
FIG. 1*f* is a simplified flow diagram illustrating a method for determining a prize associated with an instant lottery ticket according to an embodiment of the invention.
Figure 1F:
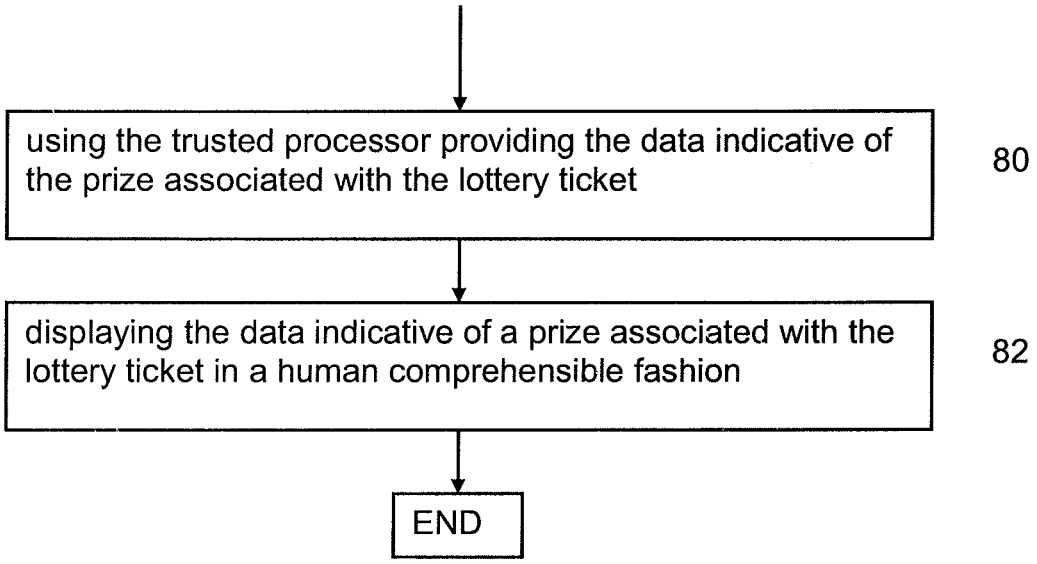

Referring to FIG. 1*f*, after purchase of the lottery ticket a player reveals—70—the identifier on the lottery ticket which was fully or at least partially concealed in a substantially tamper-proof fashion. As described herein above, the identifier is uniquely related to the lottery ticket such that each lottery ticket of the plurality of lottery tickets has a unique identifier and is uniquely related to prize data stored in the trusted database 18. The identifier is read using barcode reader 24 and processor 20 then provides—72—data indicative of the identifier via the communication network 13 to the trusted processor 16, which is in communication with the trusted database 18. Using the trusted processor 16 the received data indicative of the identifier is then compared—74—with data indicative of an identifier stored in the trusted database 18 and a comparison result is provided. If the comparison result is indicative of a match the respective prize data is retrieved—76—using the trusted processor 16. Using the trusted processor 16 the data indicative of a prize associated with the lottery ticket is determined in dependence upon the prize data—78.

Alternatively, data indicative of a prize associated with the lottery ticket is directly stored in the trusted database 18. Using the trusted processor 16 the data indicative of the prize associated with the lottery ticket is then provided—80—via the communication network 13 to the processor 20 for displaying the same—82—on display 22 to the player.

Optionally, the identifier data and the respective prize data are erased, or tagged as claimed, after retrieval, thus preventing repeated access to the data in order to further reduce the risk of tampering.

Further optionally, using the trusted processor 16 record data is determined when data indicative of a same identifier have been received at the trusted processor 16 more than one time for comparison. The record data comprise, for example, information indicating which processor 20 has provided the same identifier enabling a lottery organization to track locations—i.e. retailers—where potentially tampering has taken place.

Yet further optionally, using the trusted processor 16 record data is determined when the received data indicative of an identifier do not match data indicative of an identifier stored in the trusted database 18 to enable a lottery organization to track locations where potentially tampering has taken place.

Figure 2A:
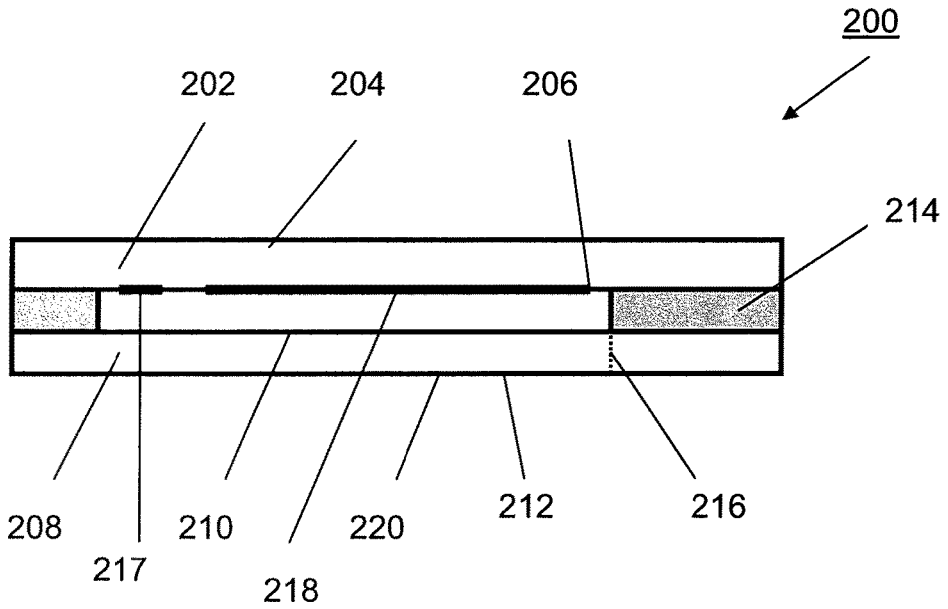
FIGS. 2*a* to 2*c* are simplified block diagrams illustrating cross-sectional views of an instant lottery ticket according to an embodiment of the invention.

Referring to FIGS. 2*a* to 2*h*, an embodiment of a lottery ticket 200 according to the invention is provided. As illustrated in FIG. 2*a*, the lottery ticket comprises a top sheet 202 having an upper surface 204 and a lower surface 206 and a bottom sheet 208 having an upper surface 210 and a lower surface 212. The upper surface 210 of the bottom sheet 208 is partially adhered to the lower surface 206 of the top sheet 202 at predetermined areas using, for example, an adhesive suitable for use with the material of the top sheet 202 and the bottom sheet 208. The top sheet 202 and the bottom sheet 208 are made of, for example, a semi-rigid sheet of paper, cardboard, or boxboard having a predetermined shape—for example, rectangular shape—and size.

Figure 2B:
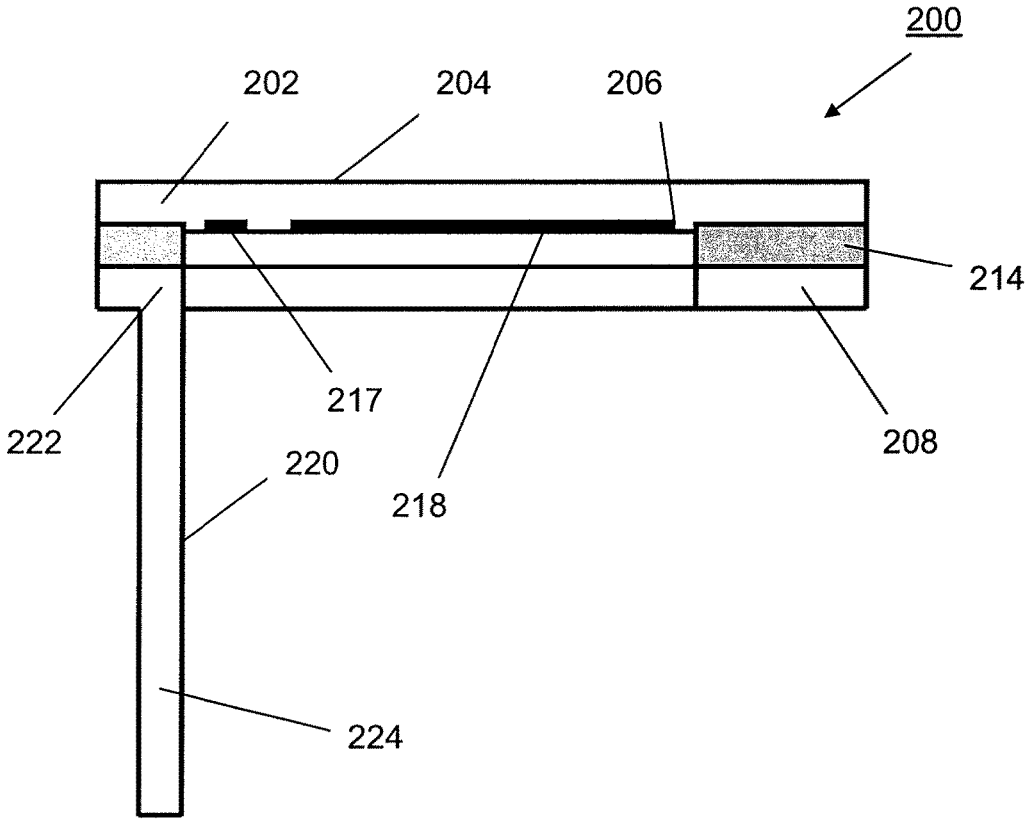

At least a tab 220 is disposed in the bottom sheet 208, as illustrated in FIGS. 2*a* and 2*b* with the tab closed and opened, respectively. The tab 220 has a hinged part 222 and a severable part 224. The severable part 224 of the tab 220 is for being severed from the bottom sheet 208 for revealing a predetermined portion 217, 218 of the lower surface 206 of the top sheet 202 with the hinged part 222 of the tab 220 being connected to the bottom sheet 208. The tab 220 is formed by disposing a perforation 216 in the bottom sheet 208 bordering at least a portion of the severable part 224 of the tab 220, as illustrated in FIGS. 2*a* to 2*d*. As is evident, the shape of the tab 220 is not limited to a rectangular shape as illustrated but various shapes such as, for example, circular, oval, triangular shapes are also applicable.

Alternatively, the at least a tab 220 is disposed in the top sheet 202 for revealing a predetermined portion of the upper surface 210 of the bottom sheet 208. Further alternatively, tabs 220 are disposed in the top sheet 202 as well as in the bottom sheet 208 for revealing respective portions of the upper surface 210 of the bottom sheet 208 and the lower surface 206 of the top sheet 202 with the portions being placed such that they are other than facing each other.

An identifier is disposed on the predetermined portion 217 of the lower surface 206 of the top sheet 202 in proximity to the hinged part 222 of the tab 220. The identifier is printed on the lower surface 206 in the form of a barcode such as, for example, a linear barcode, or a matrix barcode. Examples of linear barcodes are an interleaved 2 of 5 barcode or a PDF 417 barcode. The identifier is compared with data stored in a trusted database to, for example, validate the ticket and/or to determine a prize associated with the lottery ticket. Disposing the identifier in proximity to the hinged part 222 of the tab 220 substantially complicates tampering since the tab 220 has to be completely opened to reveal the identifier disposed on the predetermined portion 217, as illustrated in FIG. 2*b*.

Figure 2C:
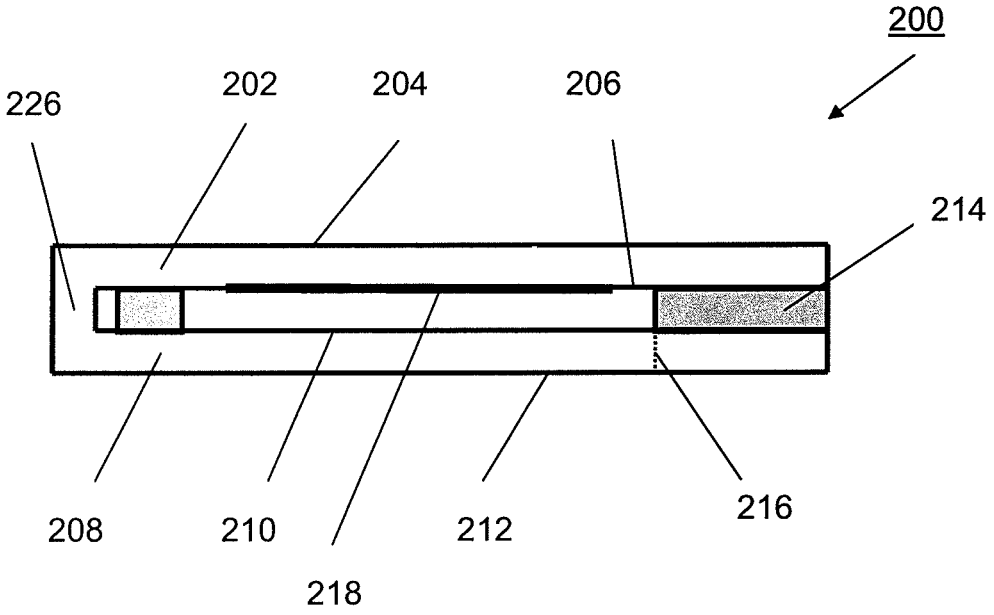
Figure 2D:
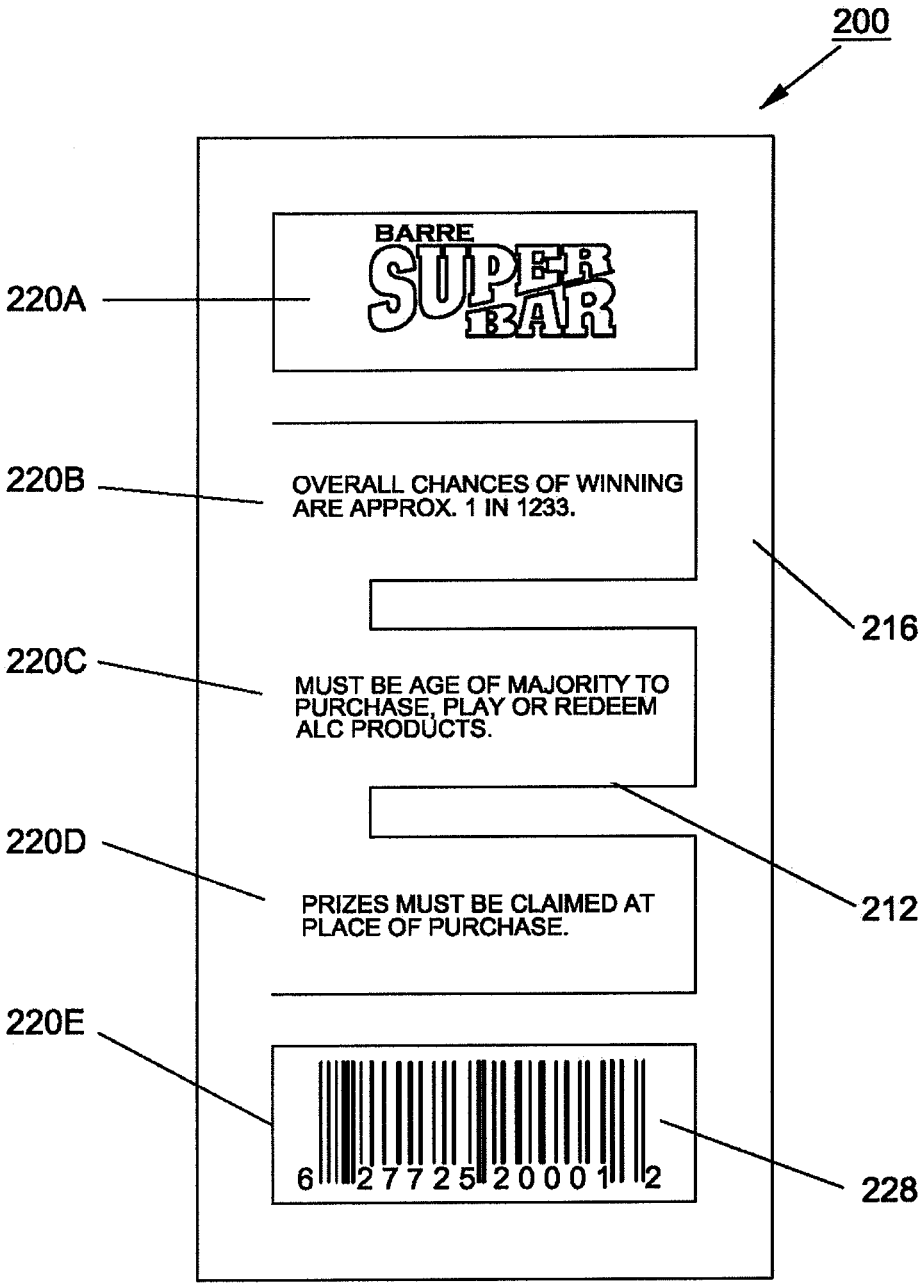
FIGS. 2*d* and 2*e* are simplified block diagrams illustrating bottom views of the instant lottery ticket according to an embodiment of the invention.
Figure 2E:
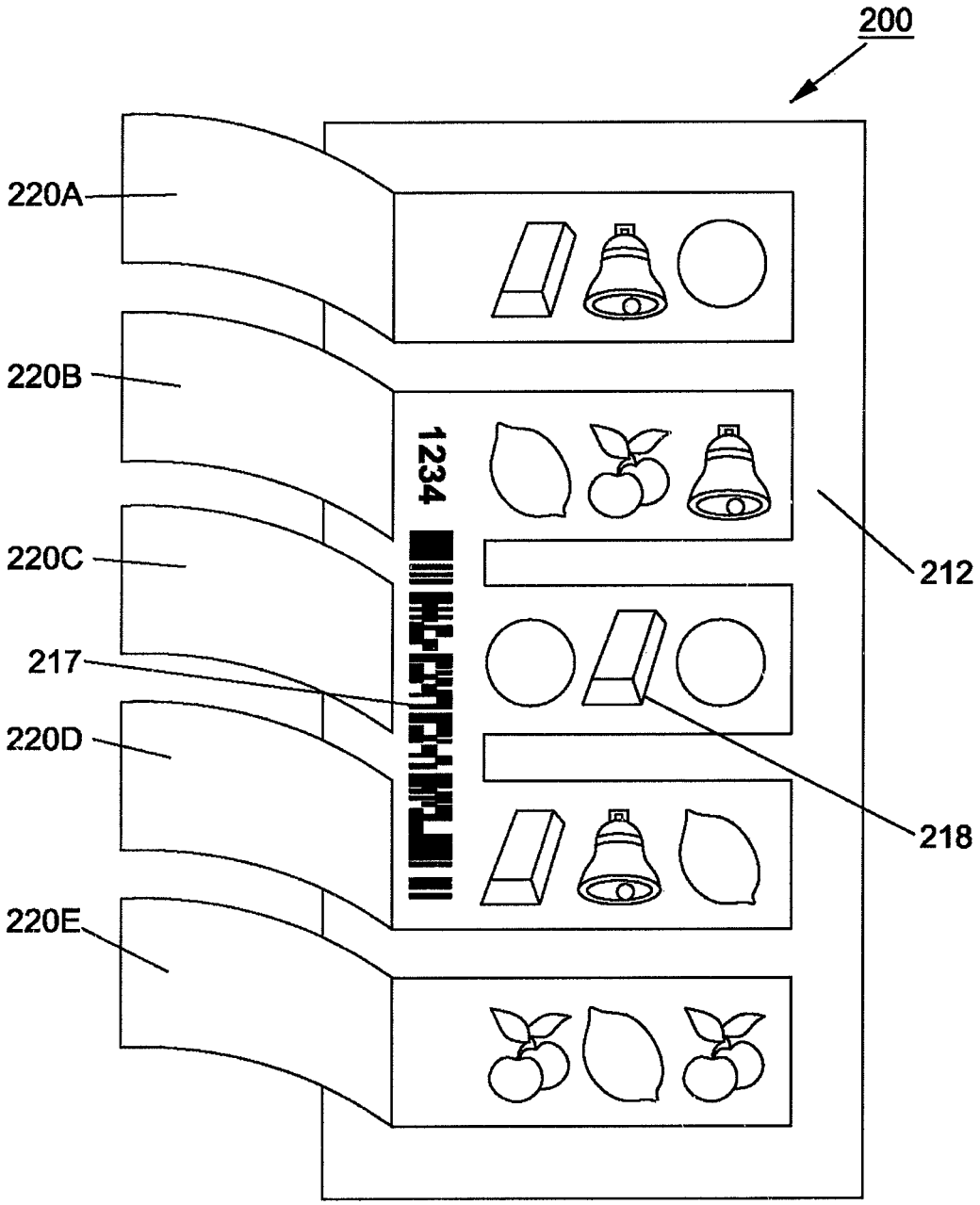

Alternatively, the top sheet 202 and the bottom sheet 208 are two parts of a folded single sheet with a fold 226 and the two parts being partially adhered together, as illustrated in FIG. 2*c*.

Alternately, the lottery ticket 200 comprises a plurality of tabs 220B, 220C, and 22D wherein the tabs are joint in proximity to the hinged part 222 such that the severable portion 224 of each of the tabs is to be severed for revealing the identifier 217, as illustrated in FIGS. 2*b* and 2*d* to 2*f*. Of course, various numbers of joint tabs are applicable for complicating tampering.

Figure 2F:
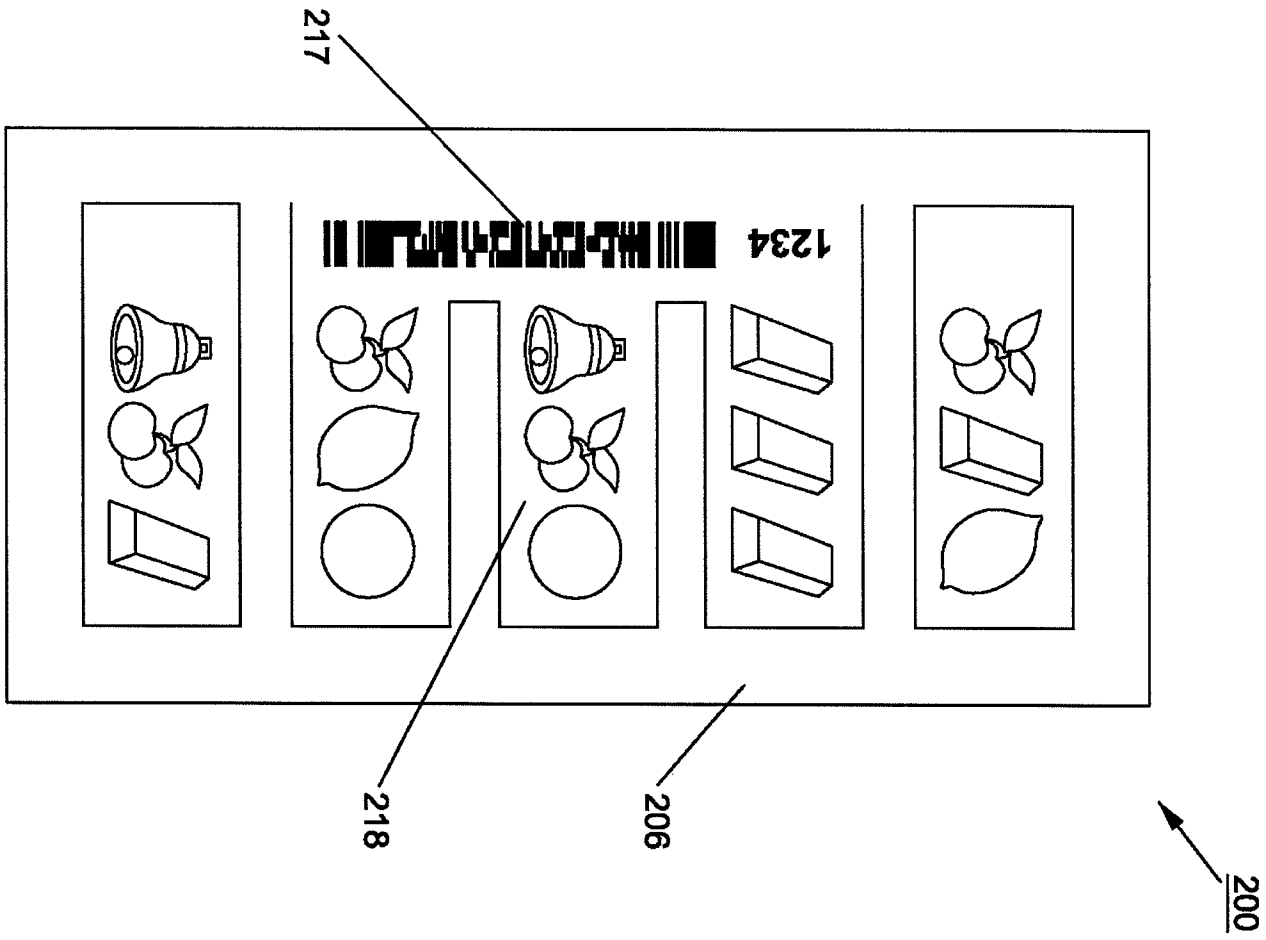
FIG. 2*f* is a simplified block diagram illustrating a bottom view of the top sheet of the instant lottery ticket according to an embodiment of the invention.
Figure 2G:
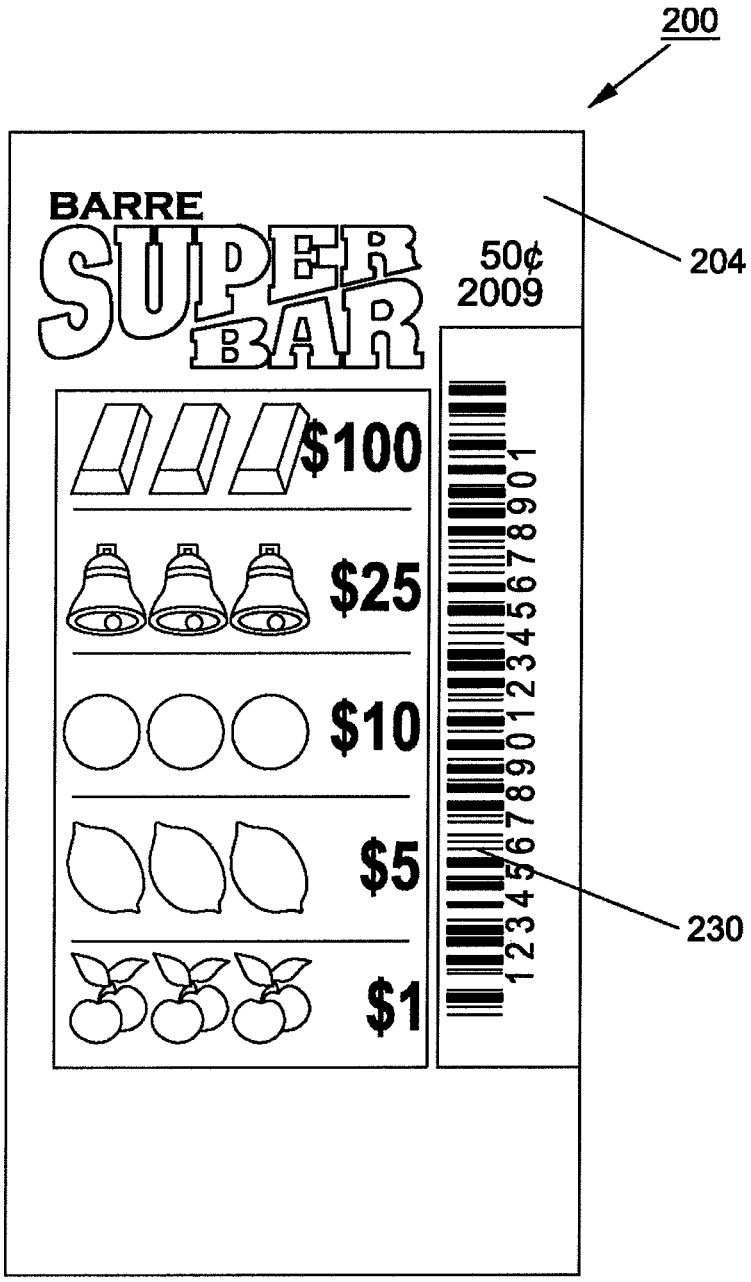
FIG. 2*g* is a simplified block diagram illustrating a top view of the instant lottery ticket according to an embodiment of the invention; and, FIG. 2*h* is a simplified block diagram illustrating a bottom view of the instant lottery ticket according to another embodiment of the invention.

Provision of break open tabs 220 enables use of lithographic printing processes for printing gaming information and appealing images on the lower surface 206 and the upper surface 204 of the top sheet 202, as illustrated in FIGS. 2*f* and 2*g*, respectively. Optionally, lithographic printing processes are also employed for printing the lower surface 212 of the bottom sheet 208.

As illustrated in FIG. 2*f*, a second identifier 230 is optionally disposed in an unconcealed fashion on the lottery ticket 200 and is, for example, indicative of a validation number or inventory number.

A UPC code 228 may be printed, for example, on the lower surface 212 of the bottom sheet 208.

Figure 2H:
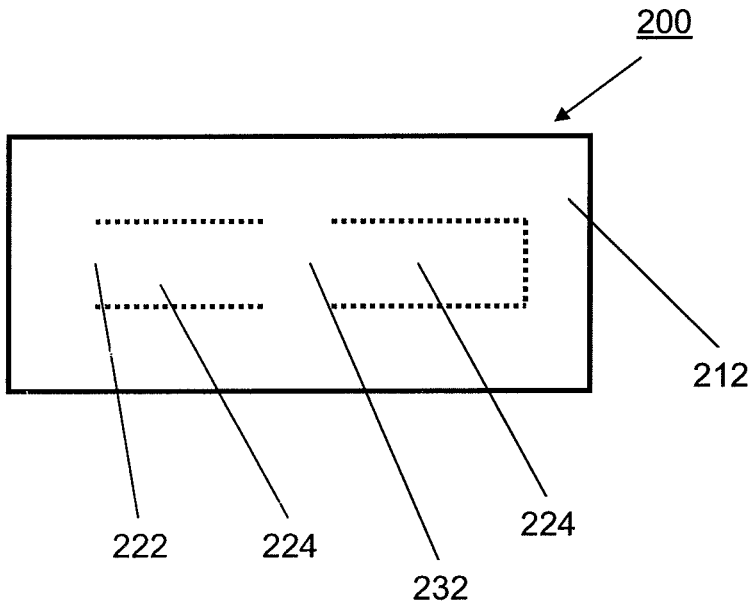

Optionally, the perforation 216 is disposed such that a portion of the bottom sheet 208 is to be torn for substantially completely revealing the predetermined portion 217, 218 of the lower surface 206 of the top sheet 202, as illustrated in FIG. 2*h*. For example, un-perforated section 232 divides the severable part 224 in two and has to be torn from the bottom sheet 208, which further complicates tampering.

The present invention has been described herein with regard to certain embodiments. However, it will be obvious to persons skilled in the art that a number of variations and modifications can be made without departing from the scope of the invention as described herein.

What is claimed is:

1. A method for determining a prize associated with a lottery ticket comprising:

a player completely opening at least two tabs of the lottery ticket, wherein the lottery ticket comprises a plurality of tabs with each tab covering a respective playing area, and wherein an identifier spans at least two playing areas;

the player severing a severable portion of at least two respective tabs for revealing the identifier, the identifier being a barcode disposed between the playing areas and a hinged end of the tabs such that the complete identifier is placed directly adjacent to the hinged end of the tab, the identifier being uniquely related to the lottery ticket such that each lottery ticket of a plurality of lottery tickets has a unique identifier and being uniquely related to prize data stored in a trusted database, the prize data being indicative of the prize associated with the lottery ticket;

the player providing the identifier to a reader for revealing the prize associated with the lottery ticket, the reader providing data indicative of the identifier to a trusted processor in communication with the trusted database;

using the trusted processor determining data indicative of the prize associated with the lottery ticket in dependence upon the data indicative of the identifier and the prize data;

using the trusted processor providing the data indicative of the prize associated with the lottery ticket; and, displaying the data indicative of the prize associated with the lottery ticket in a human comprehensible fashion.

2. A method for determining a prize associated with a lottery ticket as defined in claim 1 comprising:

using the trusted processor comparing the received data indicative of the identifier with data indicative of an identifier stored in the trusted database and providing a comparison result;

if the comparison result is indicative of a match using the trusted processor retrieving the respective prize data; and, using the trusted processor determining the data indicative of a prize associated with the lottery ticket in dependence upon the prize data.

3. A method for determining a prize associated with a lottery ticket as defined in claim 2 comprising:

erasing the identifier data and the respective prize data after retrieval.

4. A method for determining a prize associated with a lottery ticket as defined in claim 2 comprising:

using the trusted processor determining record data when data indicative of a same identifier have been received.

5. A method for determining a prize associated with a lottery ticket as defined in claim 2 comprising:

using the trusted processor determining record data when the received data indicative of an identifier do not match data indicative of an identifier stored in the trusted database.

6. A method for determining a prize associated with a lottery ticket as defined in claim 1 comprising:

determining a plurality of identifiers and associate each of the plurality of identifiers with one lottery ticket in a one-to-one relationship;

determining at least a prize;

associating the at least a prize with at least an identifier of the plurality of identifiers; and storing data indicative of the at least an identifier and the associated at least a prize in a trusted database.

7. A method for determining a prize associated with a lottery ticket as defined in claim 6 wherein the at least a prize is associated with the at least an identifier in one of a random and pseudo-random fashion.

8. A method for determining a prize associated with a lottery ticket as defined in claim 6 wherein each of the plurality of identifiers is determined in one of a random and pseudo-random fashion.

9. A method for determining a prize associated with a lottery ticket as defined in claim 6 wherein data indicative of each of the plurality of identifiers is stored in the trusted database.

10. A lottery ticket comprising:

a top sheet having an upper surface and a lower surface;

a bottom sheet having an upper surface and a lower surface, wherein the upper surface of the bottom sheet is partially adhered to the lower surface of the top sheet;

a plurality of tabs disposed in the bottom sheet, the tabs having a hinged part and a severable part, the severable part of the tabs for being severed from the bottom sheet for revealing a predetermined portion of the lower surface of the top sheet with the hinged part of the tabs being connected to the bottom sheet;

at least two playing areas disposed on the predetermined portion of the lower surface of the top sheet, each of the at least two playing areas displaying at least a play symbol, wherein each playing area is covered by a respective tab; and an identifier disposed on the predetermined portion of the lower surface of the top sheet between the playing area and the hinged end of the tab such that the complete identifier is placed directly adjacent to the hinged end of the tab, the identifier being a barcode and for being compared with data stored in a trusted database, and wherein the identifier spans at least two playing areas such that the severable portion of at least two respective tabs is to be severed for revealing the identifier.

11. A lottery ticket as defined in claim 10 wherein the tabs are joined in proximity to the hinged part such that the severable portion of each of the tabs is to be severed for revealing the identifier.

12. A lottery ticket as defined in claim 10 comprising a perforation disposed in the bottom sheet bordering at least a portion of the severable part.

13. A lottery ticket as defined in claim 12 wherein the perforation is disposed such that an un-perforated portion of the bottom sheet is to be torn for revealing the predetermined portion of the lower surface of the top sheet.

14. A method for determining a prize associated with a lottery ticket comprising:

a player completely opening a plurality of tabs of the lottery ticket with each tab covering a respective playing area, and wherein the tabs are joined in proximity to a hinged end;

the player severing a severable portion of each of the tabs for revealing the identifier, the identifier being a barcode disposed between the playing areas and a hinged end of the tabs such that the complete identifier is placed directly adjacent to the hinged end of the tab, the identifier being uniquely related to the lottery ticket such that each lottery ticket of a plurality of lottery tickets has a unique identifier and being uniquely related to prize data stored in a trusted database, the prize data being indicative of the prize associated with the lottery ticket;

the player providing the identifier to a reader for revealing the prize associated with the lottery ticket, the reader providing data indicative of the identifier to a trusted processor in communication with the trusted database;

using the trusted processor determining data indicative of the prize associated with the lottery ticket in dependence upon the data indicative of the identifier and the prize data;

using the trusted processor providing the data indicative of the prize associated with the lottery ticket; and, displaying the data indicative of the prize associated with the lottery ticket in a human comprehensible fashion.

* * * * *